United States Patent [19]

Williamson

[11] 4,113,146

[45] Sep. 12, 1978

[54] DISPOSABLE CONTAINER FOR BULK MATERIALS

[75] Inventor: Robert R. Williamson, Dallas, Tex.

[73] Assignee: Better Agricultural Goals Corporation, Dallas, Tex.

[21] Appl. No.: 460,053

[22] Filed: Apr. 11, 1974

[51] Int. Cl.[2] ..... B65D 33/14; B65D 33/28

[52] U.S. Cl. ..... 222/105; 222/181; 150/1; 229/55; 229/63

[58] Field of Search ..... 222/105, 181, 185, 92, 222/100; 150/1; 294/75, 76; 229/55, 63; 428/35, 222; 156/172

[56] References Cited

U.S. PATENT DOCUMENTS

| | | | |
|---|---|---|---|
| 1,335,607 | 3/1920 | Salisbury | 150/1 |
| 2,301,128 | 11/1942 | Landefield | 150/1 |
| 3,282,757 | 11/1966 | Brusee | 156/172 X |
| 3,374,929 | 3/1968 | Siifverskiöld | 222/105 |
| 3,570,749 | 3/1971 | Sato et al. | 150/1 X |
| 3,589,506 | 6/1971 | Ford et al. | 150/1 X |
| 3,742,664 | 7/1973 | Reding | 222/185 X |
| 3,789,897 | 2/1974 | Saito | 150/1 X |
| 3,865,339 | 2/1975 | Von Alven | 248/318 |

FOREIGN PATENT DOCUMENTS

| | | | |
|---|---|---|---|
| 1,424,260 | 11/1965 | France | 150/1 |
| 523,764 | 4/1931 | Fed. Rep. of Germany | 150/1 |
| 413,476 | 12/1966 | Switzerland | 222/181 |
| 65,639 | 6/1913 | Switzerland | 150/1 |
| 1,340,693 | 12/1973 | United Kingdom | 150/1 |

*Primary Examiner*—Stanley H. Tollberg
*Assistant Examiner*—Frederick R. Handren
*Attorney, Agent, or Firm*—Richards, Harris & Medlock

[57] ABSTRACT

Disclosed is a receptacle for transporting, storing and dispensing flowable materials. The receptacle has an outer covering formed from a single sheet of material wrapped to form a cylinder with its edges attached together in an overlapping arrangement by double-sided adhesive tape. A polyester filament is positioned inside the outer protective cover in the form of a helix. The filament is adhesively attached between the interior of the outer cover and the exterior of an inner bag. A support sling is provided of polyester webbing material having an inner ring for supporting the bottom of the receptacle and a larger outer ring. Three loops of webbing material are attached to the inner and outer rings in a spaced circumferential arrangement. The loops are of sufficient length to extend up between the outer cover and interior bag and are adhesively attached therebetween. The inner bag has inner and outer walls formed from a single sheet of polyethylene material wrapped in a spiral with the edges of the sheet attached by double-sided adhesive tape to a dividing portion on the sheet material. The outer wall is attached by non-curing mastic material. The outer wall is attached by non-curing mastic material to the interior of the outer protective covering. The inner bag is closed at its upper and lower ends by removable wire ties and the lower end extends through the center of the smaller ring of the sling.

26 Claims, 7 Drawing Figures

DISPOSABLE CONTAINER FOR BULK MATERIALS

DESCRIPTION OF THE PRIOR ART

The present invention relates to the transportation, storage and handling of flowable materials. In another aspect, the present invention relates to improvements in flexible containers for use in transporting, storage and handling of flowable materials.

Flowable materials and particularly dry particulate materials present unique problems in their storage, transportation, dispensing, handling and the like. These materials for example, include chemicals, fertilizers, minerals, foodstuffs, agricultural products, and the like. These materials have been classically handled by two main types of material handling systems. In one system, specialized bulk handling equipment is used. For example, when truck load quantity is required, the materials are loaded into a truck or railroad car at the supply location transported to the location of use and are dispensed into a hopper or other storage device. Although these systems can efficiently transport such materials, they are limited in flexibility and require that the material be handled in large quantities and be used in places convenient to these transportation systems. In addition, in many cases, material is exposed to the environment during transportation and can become contaminated.

Another system utilized provides the use of disposable paper bags. An example of this type of system can be found in the cement industry where cement, mortar, and the like are loaded in paper sacks capable of containing 50 to 100 pounds of material. The sacks are loaded on transportation equipment and are transported to the location of use, unloaded and stored in this form. The bags are individually opened at the site of ultimate use. These bags suffer from the disadvantage of having high handling costs, because they must be handled individually. In addition, loss from contamination and breakage of the porous paper bags can be substantial.

The present invention provides a new and improved system for transporting these dry flowable materials which is economical for use in transporting both large and small volumes alike. More particularly, the new and improved system of the present invention utilizes an improved receptacle which incorporates the easy handling advantages of a bag system with the economy of the bulk shipping system.

The receptacle of the present invention can be easily handled and transported by one individual with appropriate equipment even though the capacity can be as high as 70 cu. ft. or more in volume. The receptacle can be handled and transported without the necessity of pallets, thus reducing the tare weight and increasing the shipping efficiency. The receptacle provides top loading and bottom discharging which presents advantages to both the vendor and the user of the material therein. Because the receptacle is constructed from a non-porous material, such as polyethylene, polybutylene, treated paper, and the like, it can be stored and transported in an exposed condition without contamination of the material therein. The receptacle can be color coded to provide easy product identification, and can be stacked for high density storage and transportation in box cars, and the like. The size and weight capacity allows lower freight rates. The receptacle can be collapsed when empty, and reused several times if the situation warrants. The receptacle can be used with almost any dry flowable material, such as chemicals, fertilizers, minerals, foodstuffs, and agricultural products. It can be used as a dispenser and functions as a hopper when supported. It also can be used to provide a dustless discharge and is double closed at the top and bottom to prevent contamination. The receptacle can be easily repaired with a cold patch, or the like.

Therefore, according to a particular feature of the present invention, an improved material handling system is provided with an improved flexible receptacle. The receptacle has a large capacity, can be easily handled, and provides top filling and bottom discharge.

According to a particular feature of the present invention, a receptacle for transporting dry flowable materials is provided having an outer protective covering of sheet polyethylene material which can be doubled for additional strength. A double-wrapped interior bag is provided which is formed by wrapping polyethylene sheet material in a spiral with the edges sealed by double-sided adhesive tape. A polyester filament is wound in a helix around the exterior surface of the inner bag and is secured thereto by non-curing mastic. A sling of polyester webbing forms a frame for the receptacle and has an inner ring which supports the bottom of the receptacle and an outer larger ring which is positioned above the inner ring to prevent formation of pockets in the container and to facilitate complete unassisted discharge of the container. Loops of webbing interattach the upper and lower rings. The loops are attached to the inside of the outer protective covering and extend above the top thereof to form loops which can be used to support the receptacle by appropriate transporting apparatus. A removable wire tie is provided for the top and bottom of the double-walled inner bag to allow top loading and bottom discharge of the materials therein.

The features and advantages of the present invention will be readily appreciated by those of ordinary skill in the art as the same is explained by referance to the following detailed description when considered in connection with the accompanying Drawings in which:

DESCRIPTION OF THE PREFERRED EMBODIMENT

Figure 1:
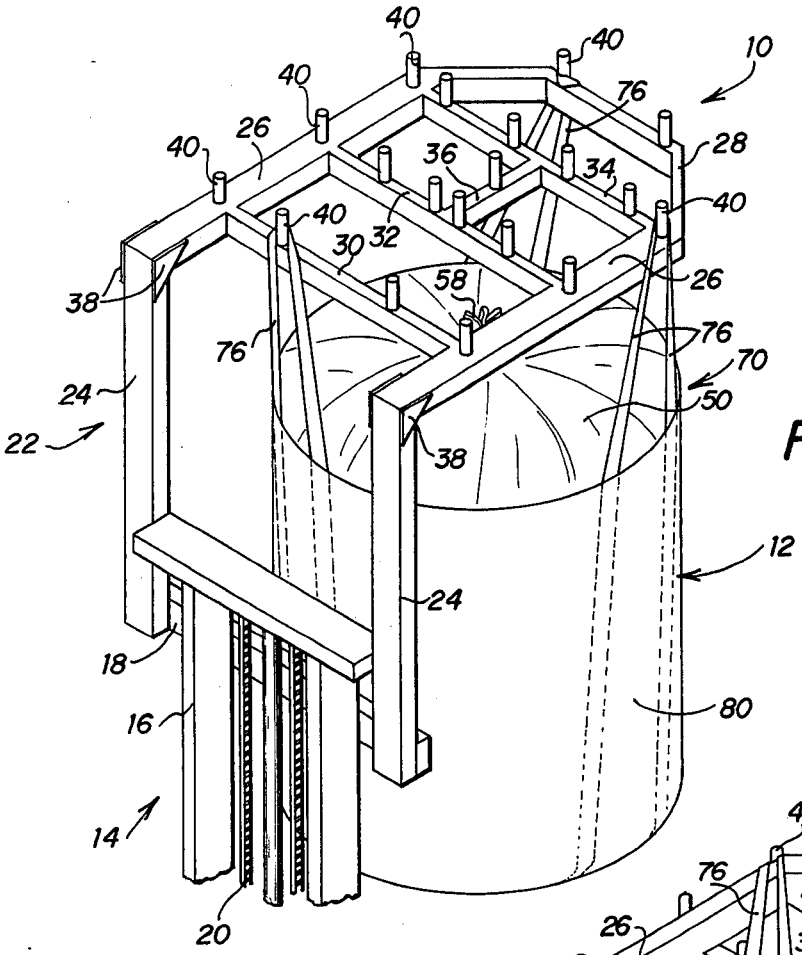
FIG. 1 illustrates a rear top perspective view of the improved receptacle of the present invention attached to a fork lift with an attachment especially adapted for lifting the receptacle thereon.
Figure 2:
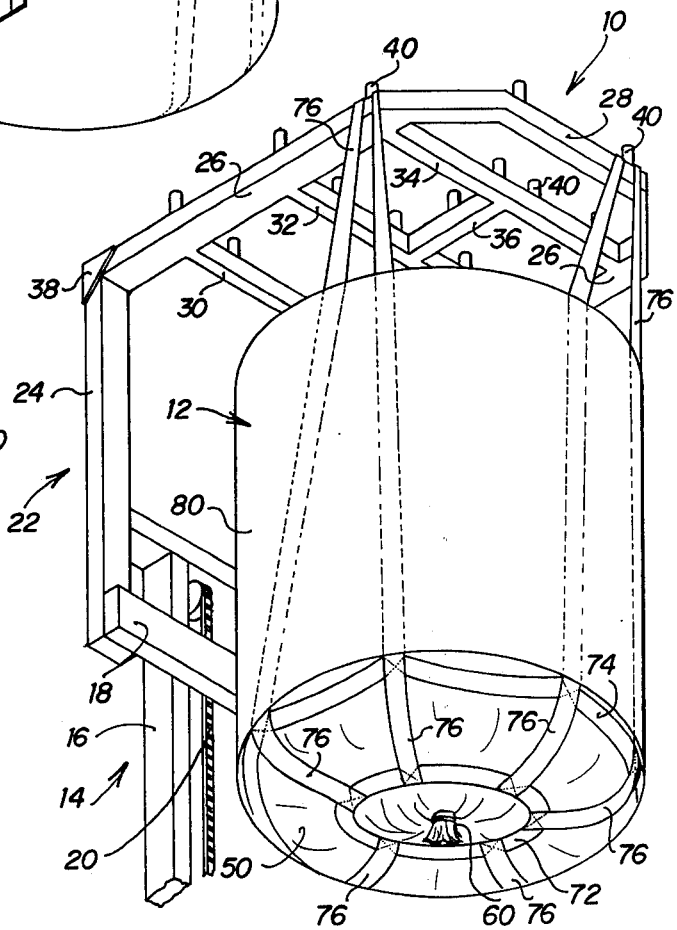
FIG. 2 is a bottom front perspective view of the apparatus illustrated in FIG. 1.
Figure 3:
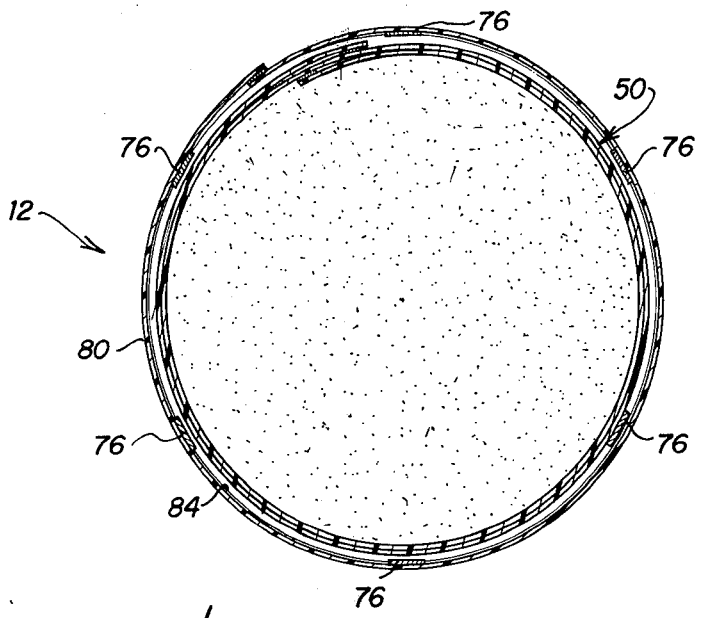
FIG. 3 is a horizontal section of the receptacle illustrated in FIGS. 1 and 2.

Referring now to the Drawings wherein like reference characters designate like or corresponding parts throughout the several views, there is illustrated in FIGS. 1 and 2, the apparatus of a system for transporting dry flowable materials, which for purposes of description is identified by reference numeral 10.

The apparatus of the system comprises an improved receptacle 12 which is shown supported from a fork lift assembly 14. The receptacle 12 provides a lightweight shipping and storage container for flowable materials. As will be shown, the receptacle 12 has top loading and bottom discharge ports and can be easily handled by one individual with conventional handling equipment. The assembly 14 is provided with an attachment 22 especially adapted for handling the receptacle 12.

The assembly 14 has a fork lift mast 16 supported from the front of a fork lift (not shown) and extends in the vertically upward direction. A cross bar 18 is supported from the mast 16 and is vertically movable with respect to the mast by means of a conventional chain lift assembly 20. It is to be understood, of course, that other types of fork trucks with other types of lift assemblies could be utilized.

A unique fork truck attachment 22 is shown attached to the cross bar 18. The attachment 22 has two upstanding vertically extending columns 24 fixed to bar 18 in a spaced parallel relationship. Two parallel horizontally extending spaced beams 26 extend horizontally out away from the ends of columns 24. The extending ends of the beams 26 are interconnected by a front frame 28. A plurality of parallel cross beams 30, 32, and 34 are attached between the beams 26 in a spaced parallel relationship and extend transverse to the beams 26. A short cross beam 36 is attached between the cross beams 32 and 34 at the centers thereof. Gussetts 38 can be provided at the joints of the respective members to add strength and rigidity thereto.

A plurality of upstanding pegs 40 are spaced about the upper surface of the attachment 22. These pegs 40 are illustrated in the present embodiment as being constructed from bar stock welded to the upper surface of the metallic fork lift attachment frame. These pegs 40 are utilized for attaching the supporting sling of the receptacle 12.

According to a particular feature of the present invention, the improved receptacle 12 comprises a bag formed of sheet material having a sling for supporting and transporting the receptacle 12. The improved receptacle 12 of the present invention is constructed with a double walled interior bag 50 and is illustrated in detail in FIGS. 3 through 6. This bag 50 is constructed from a single sheet of material which is wound in the form of a spiral with the ends 52 and 54 of the material overlapping. This is shown in detail in FIG. 5 with the outer and the inner ends 52 and 54, respectively, attached to the dividing portion of material 55 by means of strips of double-sided adhesive tape 56. Tape 56 is used in the present embodiment, but it is to be understood, of course, that other types of adhesive could be utilized to attach the edges 52 and 54 to form the inner bag 50.

Figure 4:
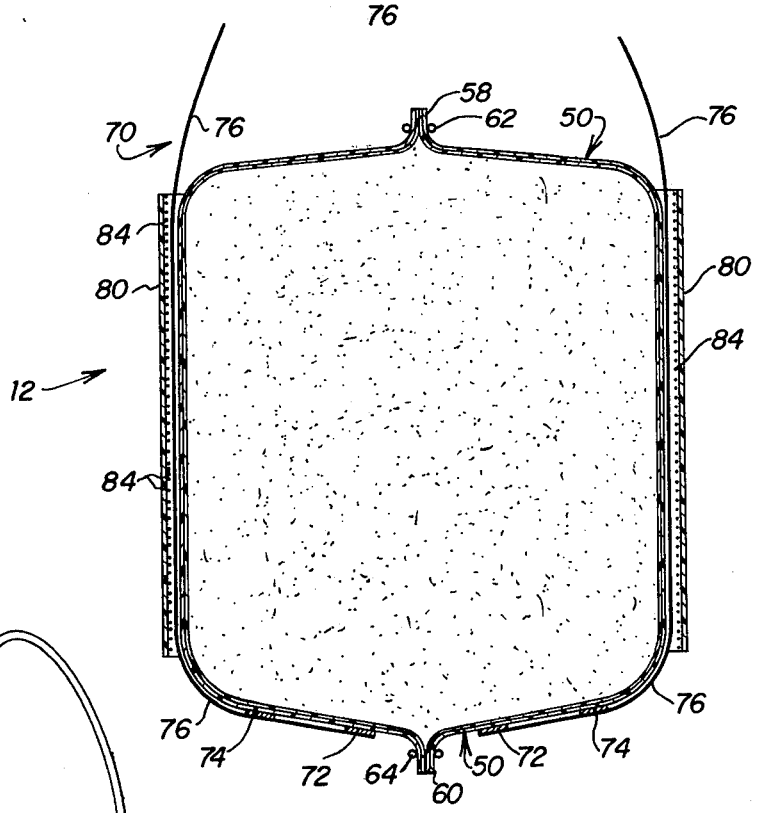
FIG. 4 is a vertical section of the receptacle illustrated in FIGS. 1 and 2.
Figure 5:
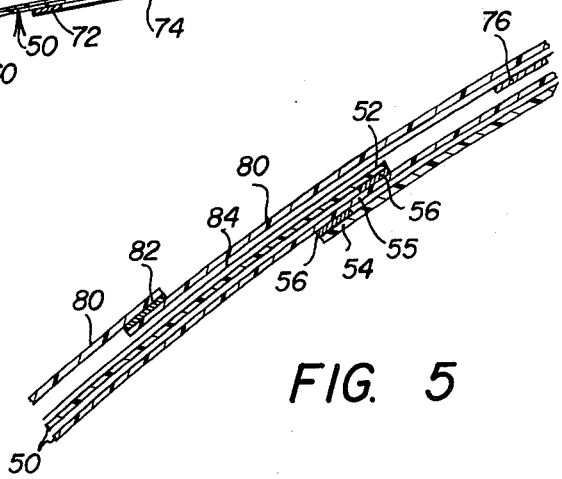
FIG. 5 is an enlarged view of a portion of FIG. 3.

With the edges 52 and 54 fixed in place, the bag 50 is cylindrical in shape. The upper end 58 and lower end 60 of bag 50 are gathered together as shown in FIG. 4, to form necks which are held closed, respectively, by an upper wire tie 62 and a lower wire tie 64. In the preferred embodiment, the wire tie can be polyvinyl chloride coated, high tensile annealed steel wire with a 0.057 inch O. D. and a five mil coating. The wires can be twisted to close the ends 58 and 60, and untwisted to open ends 58 and 60. These ends 58 and 60 can thus be used as filling and discharge ports.

Figure 6:
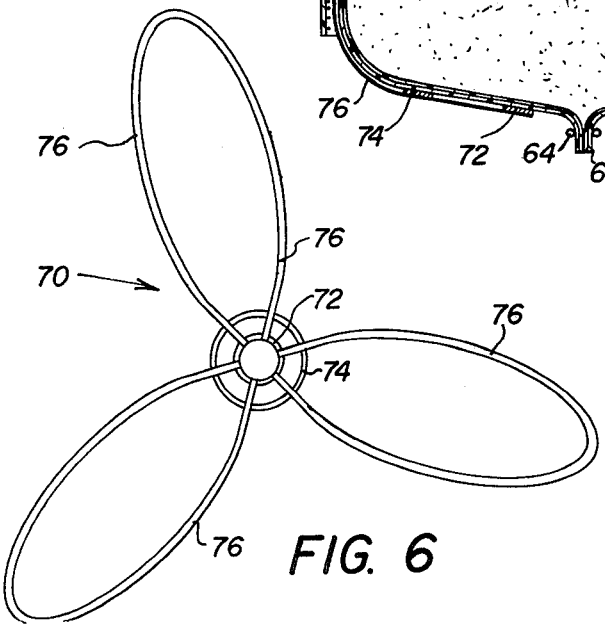
FIG. 6 is a diagram of the webbing attached to the receptacle of the present invention.

A sling assembly 70 is positioned around the exterior of the inner bag 50 for use in supporting and transporting the receptacle 12. The sling assembly 70 is shown in FIG. 6 as having an inner ring 72 for supporting the bottom of the bag 50. This inner ring and the remainder of the sling assembly 70 is preferably made from polyester webbing. A larger outer ring 74 is positioned concentric with the inner ring 72. Rings 72 and 74 are attached together as shown by three separate strips of webbing material sewn to the rings 72 and 74 to form three loops 76. The strips of webbing forming loops 76 have their ends sewn or fixed to the inner ring at concentrically spaced points and are sewn to the outer ring 74 at concentrically spaced points. The sling assembly 70 is attached to the exterior of inner bag 50 with the lower end 60 of the bag 50 extending through the center of the ring 72. The loops 76 pass up along the sides of the bag 50 and are of sufficient length to extend substantially above the top as can be seen in detail in FIGS. 1 and 2. In addition, these loops 76 are utilized for engaging and supporting the receptacle 12 by a fork lift attachment or the like as illustrated with inner ring 72 supporting the bottom of bag 50 and outer ring 74 preventing the formation of pockets therein and to facilitate complete unassisted discharge of the container.

An outer protective covering 80 can be provided for the bag 50. The outer covering can be constructed from a single sheet of material wrapped around the bag and attached to the exterior of the bag and the sling assembly 70. The edges of this sheet material are overlapped and attached together by a double-sided adhesive tape 82. As with edges of the bag 50, other types of adhesive material could be used with the covering 80. In an alternative configuration, wherein heavier loads are supported by the receptacle 12, the outer cover 80 could be doubled.

Polyester filament 84 is wound around the exterior of the bag 50 in the form of a helix to add strength to the bag. This helix of polyester filament 84 is attached by non-curing mastic to the exterior of the bag 50. In addition, the mastic attaches the sling assembly 70, outer cover 80 and bag 50 together.

In the preferred embodiment, the sheet material in bag 50 and cover 80 is VALERON film, which is a registered trademark of Royal Packaging Industries, Van Leer, New York. It is also envisioned that other materials could be used such as polybutylene film or the like. The Valeron material is preferably four mils thick. The sling is preferably constructed from polyester material two inches wide, 1/16 of an inch thick, and with a 5,000 pound tensile strength.

In use, the receptacle 12 can be lifted by engaging loops 76 by means of a fork truck, crane or other device. The receptacle 12 can be stored in an elevated position. In addition, materials can be dispensed from the lower end 50 by removing the lower wire tie 64 and materials can be added to the top of the receptacle through the upper end 58 by removing the upper tie 62. The bag 50 and its outer protective cover 80 is flexible allowing the bag to collapse as material is dispensed from the bottom thereof. This eliminates the requirement of circulating air through the container as material is removed therefrom and providing a dustless dispenser. The sheet material provides a container which is lightweight and the webbing loops 76 provide a simple structure for supporting and transporting the receptacle with the correct equipment.

The receptacle can be used to transport volumes to a practical economic size of 70 cu. ft. or more. No pallets are required for the receptacle due to the fact that the slings provide a complete support for the receptacle. The receptacle 12 can be stored outside without spoiling the material because the sheet material of the bag is non-porous. The bags can be color coded to identify the products. The receptacles have sufficient top to bottom strength to allow stacking three high. The receptacle can be used with any dry flowable materials and can be used to feed directly into process equipment. The low tare weight volume provides substantial shipping savings which are not present in conventional containers.

Figure 7:
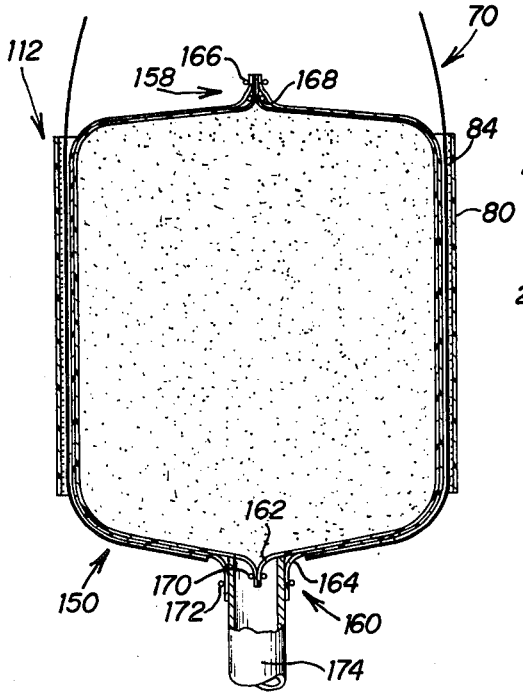
FIG. 7 is a reduced section view similar to FIG. 4, illustrating another embodiment.

An alternative embodiment of a receptacle 112 is illustrated in FIG. 7. This receptacle 112 is constructed in a manner similar to receptacle 12 except for the construction of inner bag 150. The assembly of the sling assembly 70, outer cover 80, and filaments 84 are identical in both embodiments. The inner bag 150 is formed in a a manner identical to bag 50 with double-sided tape 56 attaching edges 52 and 54 to a dividing portion 55. In bag 150, the portion 55 is slit along its length adjacent to the upper and lower ends 158 and 160, respectively. The inner and outer walls 162 and 164, respectively, are therefore separated adjacent ends 158 and 160. In an alternative structure, the upper end 158 is not slit and is constructed like end 58 in FIG. 4.

The ends of bag 150 can be sealed as illustrated in FIG. 7. In this embodiment, the upper end of inner wall 162 is closed by a wire tie 166 and the upper end of the outer wall 164 is closed by separate wire tie 168. The lower end 160 can be closed in an identical manner by inner and outer wall lower end wire ties 170 and 172, respectively.

One particular advantage of receptacle 112 is illustrated in FIG. 7, wherein the outer wall 164 is opened and sealed around the exterior of an outlet conduit 174. This conduit 174 can lead to a bin or other type of material handling equipment. The lower end of outer wall 164 can be attached to the exterior of conduit 174 by tie 172. The lower end of inner wall 162 can fit into the upper end of conduit 174.

To remove material from receptacle 112, a sharp object, such as a knife, can be inserted up through the interior of conduit 174 to pierce the lower end of the inner bag 150.

In both embodiments, the unique cooperation between the webbing forming the sling assembly, filaments 84, bags 50 and 150 and outer cover 80 provide an improved flexible receptacle.

Although the present invention is described used with dry flowable materials, it is envisioned, of course, that the teachings of the present invention could be used to transport other states of materials, such as liquids.

It is to be understood, of course, that the foregoing disclosure relates only to specific embodiments of the present invention which are disclosed for purposes of description of the invention. In view of the foregoing disclosure, it is to be understood, of course, that many other embodiments of the present invention could be used without departing from the spirit and scope of the invention as defined in the appended claims.

I claim:

1. A receptacle for flowable material comprising:

a bag of flexible sheet material defining a chamber for said materials;

said bag being formed from sheet material wrapped in a spiral with the edges adhesively attached together to form a cylindrical wall;

said sheet material being doubled to form a double walled bag;

straps attached to said sheet material at spaced locations on the exterior thereof for supporting said receptacle in a normal orientation;

selectively closable fill and discharge ports positioned, respectively, at the top and bottom of said receptacle when in said normal orientation for filling and discharging material;

the double walls of said bag being separate adjacent said fill and discharge ports; and tie means for separately closing both walls at the fill and discharge ports.

2. The receptacle of claim 1 wherein said bag is formed from polyethylene sheet material.

3. The receptacle of claim 1 wherein loops are formed by said straps.

4. The receptacle of claim 1 additionally comprising an outer cover for said bag.

5. The receptacle of claim 1 additionally comprising fiber material attached to the exterior of said bag to thereby add strength to said wall.

6. The receptacle of claim 5 wherein said fiber material is positioned around the periphery of said bag.

7. A receptacle for flowable materials comprising:

a substantially flexible bag defining a collapsible chamber for said material having a side wall of circular cross section and extending to a top wall and a generally concave bottom wall and said bag having a selectively closable discharge opening formed at the center of said bottom wall and a selectively closable fill opening at the center of said top wall;

said bag comprising a double wall bag formed from a sheet of plastic material wrapped in a spiral with the edges of the sheet adhesively attached together to form a cylinder having double walls;

the two walls of the bag being separated at least adjacent the discharge opening;

dual means for selectively closing either or both of the two walls of the bag at the discharge opening and thereby preventing the movement of flowable material therethrough;

a frame formed from flexible strap material attached to said bag for use in lifting, transporting, and discharging flowable material from said receptacle, said frame comprising:

a first endless circular belt of said strap material attached to said bottom wall of said bag and surrounding said central discharge opening;

transverse members attached to said endless circular belt at circumferentially spaced locations and extending therefrom along the sides of said bag, said adjacent transverse members being attached to the sides of said bag and converging to form loops above the upper end of said side wall for supporting said receptacle; and a second circular endless belt of said strap material attached to said transverse members at circumferentially spaced locations and surrounding the first endless belt and spaced apart therefrom for preventing the bag from forming pockets during collapse of the bag as the flowable material is discharged therefrom and thereby assuring complete discharge of the contents of the bag through said central discharge opening.

8. A receptacle for flowable materials comprising:

a bag defining a cylindrical chamber for said material and having a side wall of circular cross section, a selectively closable discharge opening formed in the bottom of said bag and a selectively closable fill opening formed in the top of said bag;

a frame formed from flexible strap material attached to said bag for use in lifting and transporting said receptacle, said frame comprising:

a first endless circular belt of said strap material attached to the bottom of said bag and surrounding the discharge port;

transverse members attached to said endless circular belt at circumferentially spaced locations and extending therefrom along the sides of said bag for supporting said receptacle said transverse member being attached to said sides of the bag and converging to form loops above said side wall for supporting said receptacle;

a second circular endless belt of said strap material attached to said transverse members at circumferentially spaced locations and surrounding the first endless belt and spaced apart therefrom for preventing the bag from forming pockets and thereby assuring complete discharge of the contents of the bag through the discharge opening;

said bag comprising a double wall bag formed from a sheet of plastic material wrapped in a spiral with the edges of the sheet adhesively attached together to form a cylinder having double walls;

the two walls of the bag being separated at least adjacent the discharge opening;

dual means for selectively closing either or both of the two walls of the bag at the discharge opening and thereby preventing the movement of flowable material therethrough.

9. A receptacle for flowable materials comprising:

a bag defining a cylindrical chamber for said material, said chamber having circular side walls extending to a top wall and a generally concave bottom wall and having a discharge opening formed in said bottom wall;

a frame formed from flexible strap material attached to said bag for use in lifting and transporting said receptacle, said frame comprising:

a first endless circular belt of said strap material attached to the bottom of said bag and surrounding the discharge port;

transverse members attached to said endless circular belt at circumferentially spaced locations and extending therefrom along the sides of said bag for supporting said receptacle;

a second circular endless belt of said strap material attached to said transverse members at circumferentially spaced locations and surrounding the first endless belt and spaced apart therefrom for preventing the bag from forming pockets and thereby assuring complete discharge of the contents of the bag through the discharge opening; and an outer cover for said bag surrounding said transverse members and extending along substantially the entire height of said side walls of said bag.

10. The receptacle of claim 9 wherein said bag is formed from flexible sheet material.

11. The receptacle of claim 9 wherein the bag is formed from polyethylene sheet material.

12. The receptacle of claim 9 wherein the bag is formed from sheet material wrapped in a spiral with the edges adhesively attached together to form a cylindrical wall.

13. The receptacle of claim 12 wherein the sheet material is doubled.

14. The receptacle of claim 12 wherein the discharge opening is defined by the end of the cylindrical wall.

15. The receptacle of claim 14 additionally comprising at least one tie for releasably closing the end of said cylindrical wall.

16. A receptacle for flowable material comprising:

a bag defining a cylindrical chamber for said material, said chamber having circular side walls extending to a top wall and a generally concave bottom wall and having a discharge opening formed in said bottom wall;

said bag comprising a double wall bag formed from a sheet of plastic material wrapped in a spiral with the edges of the sheet adhesively attached together to form a cylinder having double walls;

the two walls of the bag being separated at least adjacent the discharge opening;

dual means for selectively closing either or both of the two walls of the bag at the discharge opening and thereby preventing the movement of flowable material therethrough;

a frame formed from flexible strap material attached to said bag for use in lifting and transporting said receptacle, said frame comprising:

a first endless circular belt of said strap material attached to the bottom of said bag and surrounding the discharge port;

transverse members attached to said endless circular belt at circumferentially spaced locations and extending therefrom along the sides of said bag for supporting said receptacle;

a second circular endless belt of said strap material attached to said transverse members at circumferentially spaced locations and surrounding the first endless belt and spaced apart therefrom for preventing the bag from forming pockets and thereby assuring complete discharge of the contents of the bag through the discharge opening; and a filament wound helically around the circular side walls of the bag, said filament for substantially reinforcing the bag and maintaining the cylindrical configuration thereof.

17. A receptacle for flowable material comprising in combination:

a flexible bag defining a chamber for containing said flowable material, said bag comprising a single sheet of polyethylene material wrapped in a spiral with the edges of the sheet adhesively attached together to form a cylinder having inner and outer walls, the ends of said cylinder define fill and discharge ports for said flowable material, said walls of the cylinder are separated adjacent said discharge port, wire ties are releasably attached to each of the walls of the cylinder at said discharge port to selectively close and open said discharge port, a wire tie is releasably attached to both of said walls of said cylinder at said fill port to selectively close and open said fill port;

fiber material is attached to the exterior of said outer wall and is positioned to extend around the periphery of said outer wall, non-setting mastic material is utilized to attach said filament to the exterior of said outer wall;

a sling assembly is attached to said outer wall of said bag for use in lifting and transporting said receptacle, said sling assembly comprises a lower endless belt of said strap material positioned on said bag adjacent to and surrounding said discharge port, transverse members attached to said endless belt at spaced locations and extending along the exterior of said outer wall to positions above said bag, said transverse members being attached to said outer wall by said mastic material, and a second endless belt of strap material is attached to said transverse members at spaced locations and positioned concentric with said first endless belt around the exterior of said bag; and an outer cover for said bag comprising a sheet of flexible polyethylene material wrapped around the exterior wall of said bag and adhesively attached thereto by said mastic material.

18. A receptacle for flowable material comprising in combination:

a flexible bag defining a cylindrical chamber for containing said flowable material, said flexible bag comprising a single sheet of plastic material wrapped in a spiral with the edges of the sheet adhesively attached together to form a cylinder having double walls, the upper end of the bag comprising a fill port for admitting flowable material to said cylindrical chamber, the lower end of the bag comprising a discharge port for releasing flowable material from said cylindrical chamber, said double walls of the bag being separated at least adjacent said discharge port, dual wire tie means releasably attached to each of the walls of the bag adjacent to the discharge port to selectively close and open said discharge port, at least one wire tie means releasably attached to the walls of the bag adjacent the fill port to selectively close and open said fill port;

a filament attached to the exterior of the flexible bag and extending helically around the cylindrical chamber defined thereby to substantially reinforce the cylindrical chamber; and a sling assembly attached to the flexible bag for use in lifting and transporting said receptacle, said sling assembly comprising a lower endless circular belt of flexible strap material positioned on said flexible bag adjacent to and surrounding said discharge port, transverse members of flexible strap material attached to said endless belt at circumferentially spaced locations and extending along the cylindrical chamber to positions above said fill port, and a second endless circular belt of flexible strap material attached to said transverse members at circumferentially spaced locations and positioned concentric with and spaced apart from the first endless belt to prevent the flexible bag from forming pockets and thereby assuring complete discharge of flowable material through the discharge port.

19. The receptacle for flowable material according to claim 18 further including a layer of nonsetting mastic material for securing the filament and the sling assembly to the flexible bag.

20. The receptacle for flowable material according to claim 18 further including an outer cover comprising a sheet of flexible plastic material wrapped around the exterior of the flexible bag and adhesively secured thereto, said outer cover enclosing the filament and the sling assembly.

21. A receptacle for flowable material comprising:

a substantially flexible bag defining a collapsible cylindrical chamber for said flowable material characterized by an upstanding circular side wall, a generally concave bottom wall extending inwardly from the lower end of the side wall to a selectively closable central discharge opening, and a top wall having a selectively closable central fill opening;

said bag comprising a double wall bag formed from a sheet of plastic material wrapped in a spiral with the edges of the sheet adhesively attached together to form a cylinder having double walls;

the two walls of the bag being separated at least adjacent the discharge opening;

dual means for selectively closing either or both of the two walls of the bag at the discharge opening and thereby preventing the movement of flowable material therethrough;

a sling assembly formed from flexible strap material attached to said bag for use in lifting, transporting and discharging flowable material from said receptacle, said sling assembly comprising a first endless circular belt formed from said strap material engaging said bottom wall of the bag and surrounding said central discharge opening thereof, transverse members formed from said flexible strap material attached to said first endless circular belt at circumferentially spaced locations and extending therefrom upwardly along the side wall of the bag, said adjacent transverse members being attached to said side walls and converging to form loops above the upper end of said side wall for supporting said receptacle, and a second circular endless belt formed from said strap material attached to said transverse members at circumferentially spaced points and surrounding the first endless circular belt and spaced apart therefrom said second endless circular belt engaging the bag at the intersection of the side wall and the bottom wall for preventing the bag from forming pockets during collapse of the bag as the flowable material is discharged therefrom and thereby assuring complete discharge of the contents of the bag through the discharge opening.

22. A receptacle for flowable material comprising:

a substantially flexible bag defining a collapsible cylindrical chamber of said flowable material characterized by an upstanding circular side wall, a bottom wall extending inwardly from the lower end of the side wall to a central discharge opening, and a top wall extending inwardly from the upper end of the side wall to a closable central fill opening;

said flexible bag comprising a double wall bag formed from sheet material wrapped in a spiral with the edges attached together to form said circular side wall, wherein the two walls of the bag are separated at least adjacent the discharge opening, and further including dual wire tie means for selectively closing the discharge port and thereby preventing the movement of flowable material therethrough; and a sling assembly formed from flexible strap material attached to said bag for use in lifting and transporting said receptacle, said sling assembly comprising a first endless circular belt formed from said strap material engaged in the bottom wall of the bag and surrounding the discharge opening thereof, transverse members formed from said flexible strap material attached to said first endless circular belt at circumferentially spaced locations and extending therefrom upwardly along the side walls of the bag for supporting said receptacle, and a second circular endless belt formed from said strap material attached to said transverse member at circumferentially spaced points and surrounding the first endless circular belt and spaced apart therefrom, said second endless circular belt engaging the bag at the intersection of the side wall and the bottom wall for preventing the bag from forming pockets during collapse of the bag as the flowable material is discharged therefrom and thereby assuring complete discharge of the contents of the bag through the discharge opening.

23. A receptacle for flowable material comprising:

a bag defining a cylindrical chamber for said flowable material characterized by an upstanding circular side wall and a bottom wall extending inwardly from the lower end of the side wall to a central discharge opening;

said bag comprising a double wall bag formed from a sheet of plastic material wrapped in a spiral with the edges of the sheet adhesively attached together to form a cylinder having double walls;

the two walls of the bag being separated at least adjacent the discharge opening;

dual tie means for selectively closing the discharge opening and thereby preventing the movement of flowable material therethrough;

a filament wound helically around the side wall of the bag, said filament for substantially reinforcing the bag and maintaining the cylindrical configuration thereof;

a sling assembly formed from flexible strap material attached to said bag for use in lifting and transporting said receptacle, said sling assembly comprising a first endless circular belt formed from said strap material engaging the bottom wall of the bag and surrounding the discharge opening thereof, transverse members formed from said flexible strap material attached to said first endless circular belt at circumferentially spaced locations and extending therefrom upwardly along the side wall of the bag for supporting said receptacle, and a second circular endless belt formed from said strap material attached to said transverse members at circumferentially spaced points and surrounding the first endless circular belt and spaced apart therefrom, said second endless circular belt engaging the bag at the intersection of the side wall and the bottom wall for preventing the bag from forming pockets and thereby assuring complete discharge of the contents of the bag through the discharge opening.

24. The receptacle for flowable material according to claim 23 wherein each of the transverse members comprises a first portion having an end secured to the first endless circular belt and extending upwardly therefrom along the side wall of the bag to an upper loop, and a second portion extending downwardly from the upper loop along the side wall of the bag to an end secured to the first endless circular belt.

25. A receptacle for flowable materials comprising:

a bag of flexible material defining a cylindrical chamber for said flowable material comprising a circular side wall and a bottom wall extending inwardly from the side wall to a central discharge opening;

said bag comprising a double wall bag formed from a sheet of plastic material wrapped in a spiral with the edges of the sheet adhesively attached together to form a cylinder having double walls;

the two walls of the bag being separated at least adjacent the discharge opening;

dual means for selectively closing either or both of the two walls of the bag at the discharge opening and thereby preventing the movement of flowable material therethrough;

a filament attached to the side wall of the flexible bag and extending helically therearound for reinforcing the bag and maintaining the cylindrical configuration of the chamber;

flexible sling means engaging the bottom wall of the bag and extending upwardly therefrom along the side walls for supporting and transporting the receptacle;

a layer of adhesive material securing the filament and the sling means to the bag;

the sling means comprising a first endless circular belt engaging the bottom wall of the bag and surrounding the discharge opening, transverse members each secured to the first endless circular belt and extending upwardly therefrom, and a second endless circular belt secured to the transverse members and surrounding and spaced apart from the first endless circular belt, said second endless circular belt engaging the bag at the intersection of the side and bottom walls for preventing the formation of pockets in the bag and thereby assuring complete outflow of material through the discharge opening.

26. A receptacle for flowable materials comprising:

a bag of flexible material defining a cylindrical chamber for said flowable material comprising a circular side wall and a bottom wall extending inwardly from the side wall to a central discharge opening;

said bag comprising a double wall bag formed from a sheet of plastic material wrapped in a spiral with the edges of the sheet adhesively attached together to form a cylinder having double walls;

the two walls of the bag being separated at least adjacent the discharge opening;

dual means for selectively closing either or both of the two walls of the bag at the discharge opening and thereby preventing the movement of flowable material therethrough;

a filament attached to the side wall of the flexible bag and extending helically therearound for reinforcing the bag and maintaining the cylindrical configuration of the chamber;

flexible sling means engaging the bottom wall of the bag and extending upwardly therefrom along the side walls for supporting and transporting the receptacle;

a layer of adhesive material securing the filament and the sling means to the bag;

the sling means comprising a first endless circular belt engaging the bottom wall of the bag and surrounding the discharge opening, transverse members each secured to the first endless circular belt and extending upwardly therefrom, and a second endless circular belt secured to the transverse members and surrounding and spaced apart from the first endless circular belt, said second endless circular belt engaging the bag at the intersection of the side and bottom walls for preventing the formation of pockets in the bag and thereby assuring complete outflow of material through the discharge opening; and an outer layer of flexible sheet material wrapped around the exterior of the double wall flexible bag and adhesively secured thereto, said outer layer enclosing the filament and the portions of the transverse members of the sling means extending along the side walls of the bag.

* * * * *

UNITED STATES PATENT AND TRADEMARK OFFICE

CERTIFICATE OF CORRECTION

PATENT NO. : 4,113,146

DATED : September 12, 1978

INVENTOR(S) : Robert R. Williamson

It is certified that error appears in the above-identified patent and that said Letters Patent are hereby corrected as shown below:

In The Abstract, line 21, delete "The outer wall is attached by non-curing mastic material."

Column 2, line 40, "referance" should be --reference--.

Column 3, line 62, "0.057" should be --.057--.

Column 5, line 28, after "by" insert --a--.

Column 10, line 46, "chamber of said" should be --chamber for said--.

Signed and Sealed this

*Third* Day of *July 1979*

[SEAL]

*Attest:*

*Attesting Officer*

LUTRELLE F. PARKER

*Acting Commissioner of Patents and Trademarks*